US011295714B2

(12) United States Patent
Gill et al.

(10) Patent No.: US 11,295,714 B2
(45) Date of Patent: Apr. 5, 2022

(54) SYSTEM AND METHOD FOR MUSIC PRODUCTION

(71) Applicant: inMusic Brands, Inc., Cumberland, RI (US)

(72) Inventors: Daniel Gill, Providence, RI (US); Geoff Smith, Lode (GB); Pete Goodliffe, Cambridge (GB); John O'Donnell, Fort Lauderdale, FL (US)

(73) Assignee: INMUSIC BRANDS, INC., Cumberland, RI (US)

( * ) Notice: Subject to any disclaimer, the term of this patent is extended or adjusted under 35 U.S.C. 154(b) by 0 days.

(21) Appl. No.: 16/746,302

(22) Filed: Jan. 17, 2020

(65) Prior Publication Data

US 2020/0251079 A1 Aug. 6, 2020

Related U.S. Application Data

(60) Provisional application No. 62/793,861, filed on Jan. 17, 2019.

(51) Int. Cl.
*G10H 1/00* (2006.01)
*G10H 1/34* (2006.01)

(52) U.S. Cl.
CPC ..... *G10H 1/0066* (2013.01); *G10H 1/0008* (2013.01); *G10H 1/34* (2013.01); *G10H 2220/096* (2013.01); *G10H 2220/161* (2013.01)

(58) Field of Classification Search
CPC ..... G10H 1/0066; G10H 1/00; G10H 1/34; G10H 2240/056; G10H 2240/325; G10H 2240/311; G10H 2240/131; G10H 1/36; G10H 2210/101; G10H 2210/141; G10H 2240/125; G10H 2230/275; G10H 2220/091; G10H 2240/121; G10H 2210/105; G10H 2210/005; G10H 5/00
See application file for complete search history.

(56) References Cited

U.S. PATENT DOCUMENTS

| | | | | |
|---|---|---|---|---|
| 7,342,164 | B2 * | 3/2008 | Nishibori | G10H 1/0016 84/464 R |
| 7,394,010 | B2 * | 7/2008 | Nishibori | G10H 1/06 84/464 A |
| 9,159,307 | B1 * | 10/2015 | Ludovici | G10H 1/055 |
| 10,380,982 | B1 * | 8/2019 | Hovey | G10H 1/344 |
| 10,955,984 | B2 * | 3/2021 | Decker | G10H 1/0066 |
| 2010/0064880 | A1 * | 3/2010 | Takehisa | G10H 1/24 84/609 |
| 2010/0064881 | A1 * | 3/2010 | Takehisa | G10H 3/146 84/609 |
| 2013/0239787 | A1 * | 9/2013 | McMillen | G06F 1/16 84/643 |
| 2016/0019875 | A1 * | 1/2016 | Moriyama | G10H 1/0091 84/602 |
| 2017/0109127 | A1 * | 4/2017 | Osborn | G10H 1/0058 |
| 2018/0061383 | A1 * | 3/2018 | Hovey | G10H 1/0066 |
| 2020/0126525 | A1 * | 4/2020 | Gill | G10H 1/0066 |
| 2020/0251079 | A1 * | 8/2020 | Gill | G10H 1/0066 |

* cited by examiner

*Primary Examiner* — Marlon T Fletcher
(74) *Attorney, Agent, or Firm* — Burns & Levinson LLP

(57) ABSTRACT

A controller device for the production of electronic music includes multiple control surfaces, including a touch sensitive display and a matrix of actuator pads, each of which are capable of operating in different modes simultaneously.

15 Claims, 11 Drawing Sheets

SYSTEM AND METHOD FOR MUSIC PRODUCTION

FIELD OF THE INVENTION

The disclosure relates to electronic musical instruments, and, more particularly, to a controller for music production that enables production of music as a standalone device.

BACKGROUND OF THE INVENTION

In music production devices that utilize a display and a control surface having a number of buttons, pads or potentiometers, the operational mode of the display and its corresponding virtual image as well as that of the control service are typically locked together. For example, if the user selects to enter a launch mode, both the display and the control surface enter the launch mode. This condition is true for other modes, e.g. edit, record, etc. Such synchronization makes the music production device less functional as it requires excessive mode switching during content creation, arrangement and live performance. The controls or control surfaces in the music production device also enter the same selected operational mode as the display.

Accordingly, a need exists for a music production device in which the display and the control surface of the device may simultaneously have different user selectable operational modes.

A further need exists for a music production device in which the display and multiple different control surface may simultaneously have different user selectable operational modes.

A still further need exists for a music production device in which control surface may be split to simultaneously have different user selectable operational modes.

Another need exists for a music production device in which a control surface may be temporarily used to enable changes in the operational mode of the display or control surfaces.

SUMMARY OF THE INVENTION

Disclosed is a device to facilitate electronic music production that permits a user to have independent and flexible control sections capable of being assigned different operational modes enabling the user to have immediate access to different types of controls at the same time.

More specifically, disclosed is a device having an interface which provides immediate access to different types of controls at the same time to facilitate electronic music production. The device comprises a display and at least one control surface. In one embodiment, the display may be implemented with a touch sensitive display and the control surface may be implemented with an array of touch sensitive pads or actuators. The pad array and the touch display can operate independently in different modes. For example the display may be in launch mode allowing the user to launch audio clips using the touch display while the pad array simultaneously is in a note mode, enabling a user to enter notes from the pad array. The disclosed control device may operate as a full stand-alone device or as a controller for an application running on a computer via either a wired connection or a wireless connection.

In one embodiment the pad array comprises an array of touch sensitive pads that can be split into different operational modes, e.g. four rows of pads in launch mode, and four rows in note mode, with still other controls of the interface independently configured to other modes. In one embodiment, the disclosed control device comprises four independent control sections, e.g. pad array subgroup one, pad array subgroup two, controls with dedicated displays, and a touch sensitive display, each of which is capable of simultaneously operating in its own independent mode which may be different or the same from the modes of the other control sections.

According to one aspect of the disclosure, a music production device comprises: an array of actuator pads; a display; a processor operatively coupled to the array of actuator pads and the display and responsive to user commands for assigning a mode of operational to each of the display and at least a subgroup of the actuator pads, wherein the display and the at least subgroup of the actuator pads are simultaneously operable in different respective modes of operation. In one embodiment, the processor is capable of configuring the display into a launch mode of operation enabling touch initiated launching of sound samples and further capable of configuring the subgroup of the actuator pads simultaneously into a note mode of operation for enabling touch-initiated notes or MIDI events. In other embodiments, the processor is capable of configuring the display into an edit mode of operation enabling editing of sound samples and further capable of configuring the subgroup of the actuator pads simultaneously into a note mode of operation for enabling touch-initiated notes or MIDI events. In other embodiments, the music production device further comprises a plurality of controllers operatively coupled to the processor, and the processor is responsive to a user commands for assigning a mode of operational to the plurality of controllers, with the array of actuator pads, the display and the plurality of controllers being configurable to simultaneously operate in different respective modes of operation.

According to another aspect of the disclosure, a method for producing music comprises: A) providing a music production device comprising: i) an array of actuator pads; ii) a display; and iii) a processor operatively coupled to the array of actuator pads and the display and responsive to user commands for assigning a mode of operational to each of the display and at least a subgroup of the actuator pads, wherein the display and the at least subgroup of the actuator pads are simultaneously operable in different respective modes of operation; B) receiving a user commands initiating entry of the display into a first mode of operation; C) receiving a user command initiating entry of the array of pad actuators into a second mode of operation, different from the first mode of operation of the display; and D) operating the display and the array of actuator pads while simultaneously in different respective user initiated modes. In embodiments, D) may comprise: D1) receiving user-defined data through the display when the display is operating in a first operational mode, and D2) receiving user-defined data through the array of actuator pads while the array of actuator pads is simultaneously operating in a second operational mode, different from the first operational mode in which the display is operating.

According to yet another aspect of the disclosure, a music production device comprises: an array of actuator pads, the array of actuator pads definable into a first subgroup of actuator pads and a second subgroup of actuator pads; a touch sensitive display; a plurality of controllers; a processor operatively coupled to the array of actuator pads, the touch sensitive display and the plurality of controllers; and wherein the processor is responsive to user commands for assigning a mode of operational to the first subgroup of actuator pads, the second subgroup of actuator pads, the touch sensitive display and the plurality of controllers, and wherein one of the first subgroup of actuator pads and the second subgroup of actuator pads is configurable to simultaneously operate in different respective mode of operation than a mode of operation in which the display is simultaneously operating.

DESCRIPTION OF THE FIGURES

The accompanying drawings, which comprise a part of this specification, illustrate several embodiments and, together with the description, serve to explain the disclosed principles. In the drawings.

DETAILED DESCRIPTION

The present disclosure will be more completely understood through the following description, which should be read in conjunction with the drawings. In this description, like numbers refer to similar elements within various embodiments of the present disclosure. The skilled artisan will readily appreciate that the methods, apparatus and systems described herein are merely exemplary and that variations can be made without departing from the spirit and scope of the disclosure. The terms comprise, include, and/or plural forms of each are open ended and include the listed parts and can include additional parts that are not listed. The term and/or is open ended and includes one or more of the listed parts and combinations of the listed parts.

FIGS. 1 through 11, inter alia, illustrate a music production device 10 capable of implementing the methods and techniques described herein. A device suitable for implementing the subject matter disclosed herein is the Akai Professional Force, commercially available from inMusic Brands, Inc. of Cumberland, R.I., 02864. Music production device 100 comprises a housing 12 encompassing the processing, memory, control surfaces and audio interface which communicate with other devices external to device 10. Each of the major components of music production device 100 are described in greater detail herein.

Figure 1:
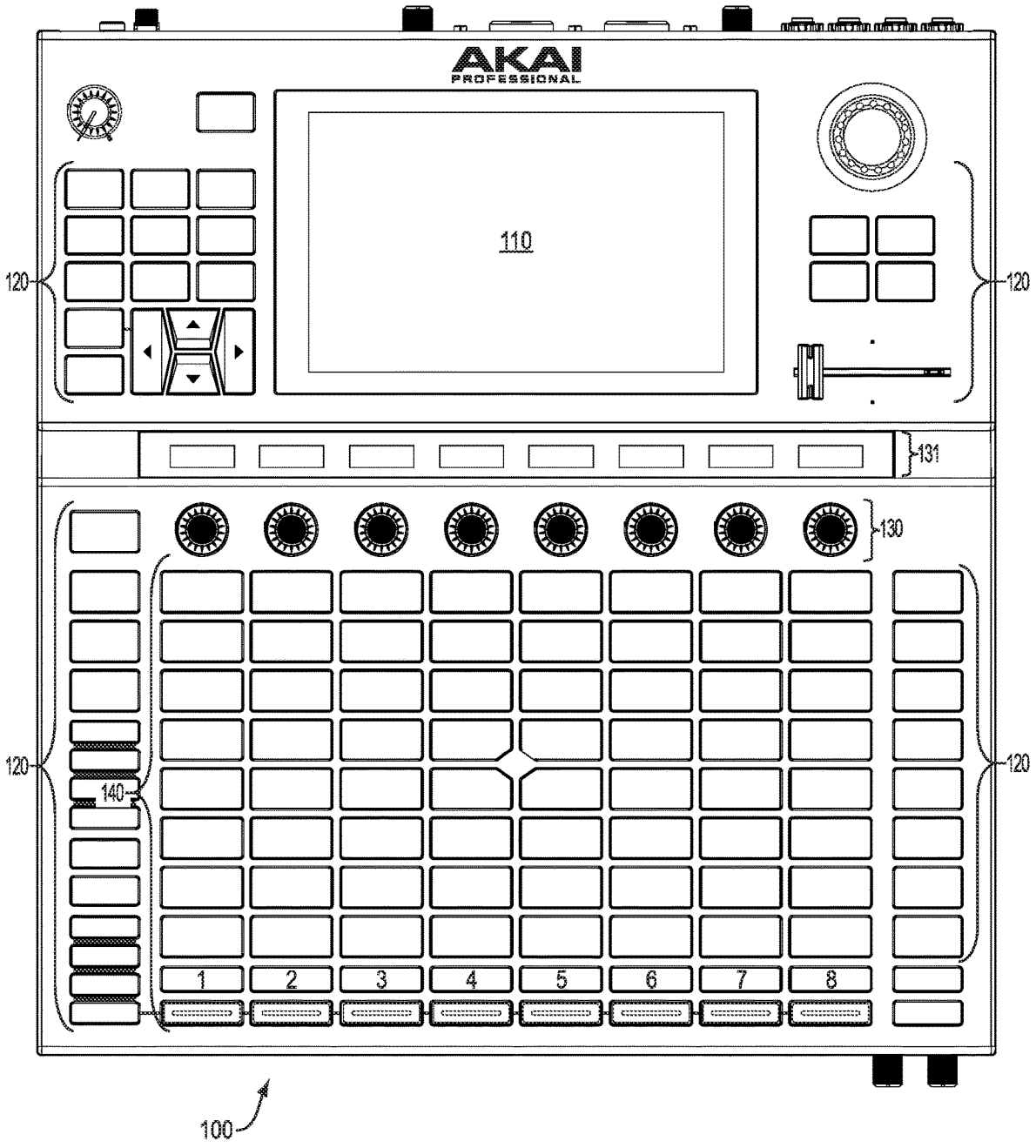
FIG. 1 is a top view of an exemplary music production device in accordance with the disclosure.
Figure 2:
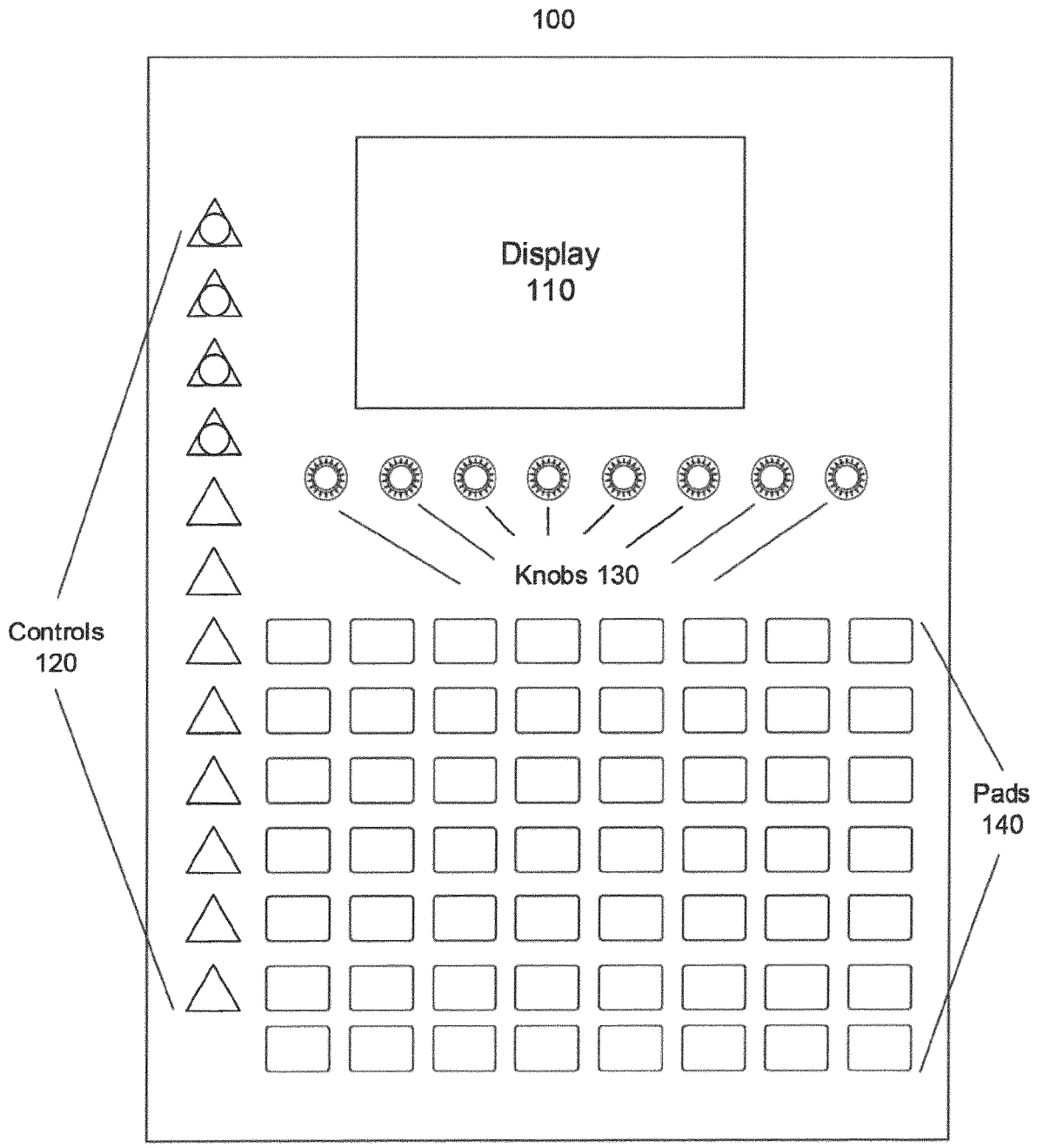
FIG. 2 illustrates conceptually a top view of the device of FIG. 1 in accordance with the disclosure.

FIGS. 1-2 are top views of an exemplary device 100 for producing music, including one or more operations, consistent with the present disclosure. In one embodiment, device 100 may comprise a primary display 110, one or more configurable controls 120, one or more configurable potentiometers 130, an actuator pad array 140, and one or more secondary displays 131 assigned to each potentiometer 130.

Primary display 110 serves as one of the primary control surfaces of device 110 may be implemented with a liquid crystal display (LCD), and, more specifically, with a touch sensitive display a menu control, one of controls 120 will allow a user to select from a menu of possible modes displayed on display 110. Also, pressing a dedicated control and 20 on the control surface of device 100 enables the display 110 to enter the various views associated with that particular operational mode including, but not limited to a matrix view, clip view, mixer view, pad mixer, and navigate view. Multiple touch zones, for example, a user may select a clip on the display by pressing the area of the display representing the clip with fingers. Display 110 is capable of creating virtual images of multiple different types of data in accordance with the various operational modes of device 110, as explained hereinafter. Display 110 is operational in multiple different modes, each of which may have one or more different virtual image formats.

Configurable controls 120 may be implemented with any of switches, potentiometers, buttons, dials, crossfaders, or other known controls and may have various functions as described herein. In one implementation, controls 120 are utilized to initiate entry of the display 110, other controls 130 or the actuator pad array 140 into various operational modes. Knobs 130 may be implemented with programmable potentiometers whose function changes depending on their respective operational mode. Each of knobs 130 has associated with there with a secondary display in close proximity thereto. In one embodiment, the housing of device 100 has tiered work surfaces and displays 131 are disposed at an angle between display 110 and the work surface containing knobs 130 and pad array 142 facilitate better visualization of information displayed thereby.

Secondary displays 131 may be implemented with any of, a liquid crystal display (LCD), a light emitting diode screen (LED), an organic light emitting diode screens (OLED), or other known display screens. A display 131 may display various kinds of information, to be described below. Like primary display 110, secondary displays 131 are operational in multiple different modes, each of which may have one or more different virtual image formats capable of creating virtual images of different types of data in accordance with the operational mode of the knob 130 with which the display 131 is associated.

In embodiments, pad array 140 may be implemented with an 8×8 array or grid of actuator pads. Array configurations with different numbers of actuator pads may also be utilized, e.g. 5×8, 4×8, etc. One or more pads within the pad array 140 may be velocity-sensitive. A velocity-sensitive pad responds to how quickly or slowly a user triggers the pad, enabling the velocity to act as a control signal to any number of different musical parameters such as filter frequency cut off, amplitude or other effect. One or more pads within the pad array may be pressure-sensitive. A pressure-sensitive pad responds to how firmly or softly a user touches the pad, enabling the velocity to act as a control signal to any number of different musical parameters such as filter frequency cut off, amplitude or volume or other effect. For example, if a user presses the pad hard, sound may be louder than when the user presses the pad softly. Moreover, Pads 140 may be configured by a display and/or controls. For example, pressing a note control 120 will cause the array 142 entered the note mode allowing the pad array to record notes chromatically similar to a midi keyboard. In the note mode the actuator pad array 140 may be used to play a configurable scale of MIDI notes. In addition, the array 140 may be used to play scales, chords, progressions and trigger drum clips.

Figure 5:
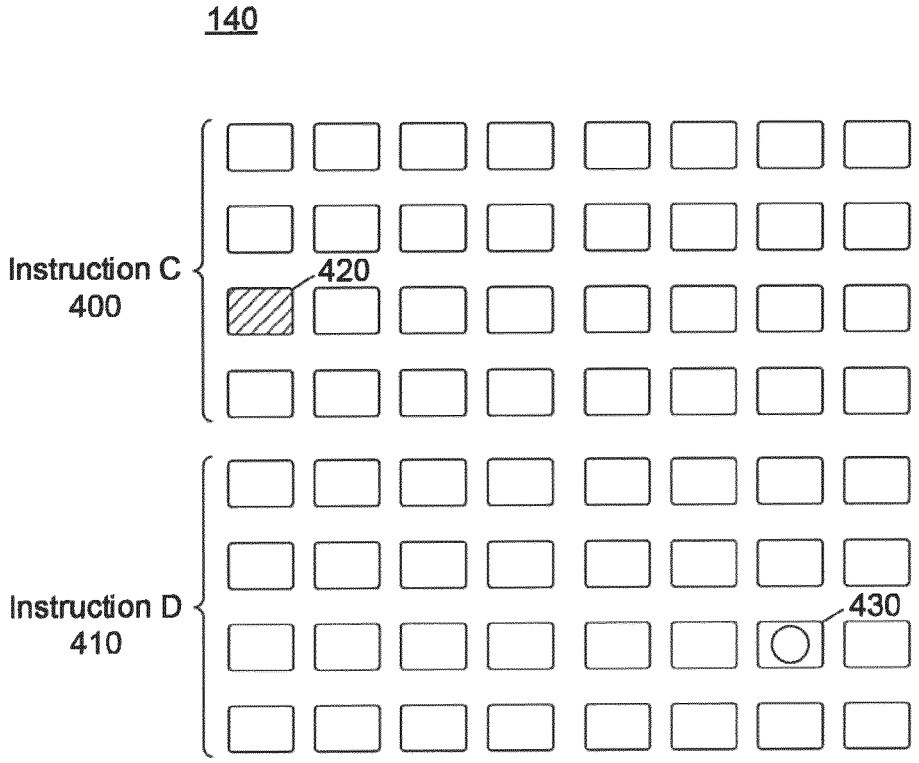
FIG. 5 illustrates conceptually a pad matrix of the device of FIG. 1 split to provide different operational functionality in accordance with the disclosure.

In the illustrated embodiment, the actuator pad array 140 is dividable into separate subgroups of actuator pads. Such subgroups may be functionally defined using one of controls 120. In an illustrative embodiment, the pad array 140 may be divided a number of rows, e.g. between the top four rows and the bottom four rows, as illustrated in FIG. 5. Other subgroup configurations by row or column of the matrix comprising actuator pad array 140 are also possible and within the scope of this disclosure.

Figure 10:
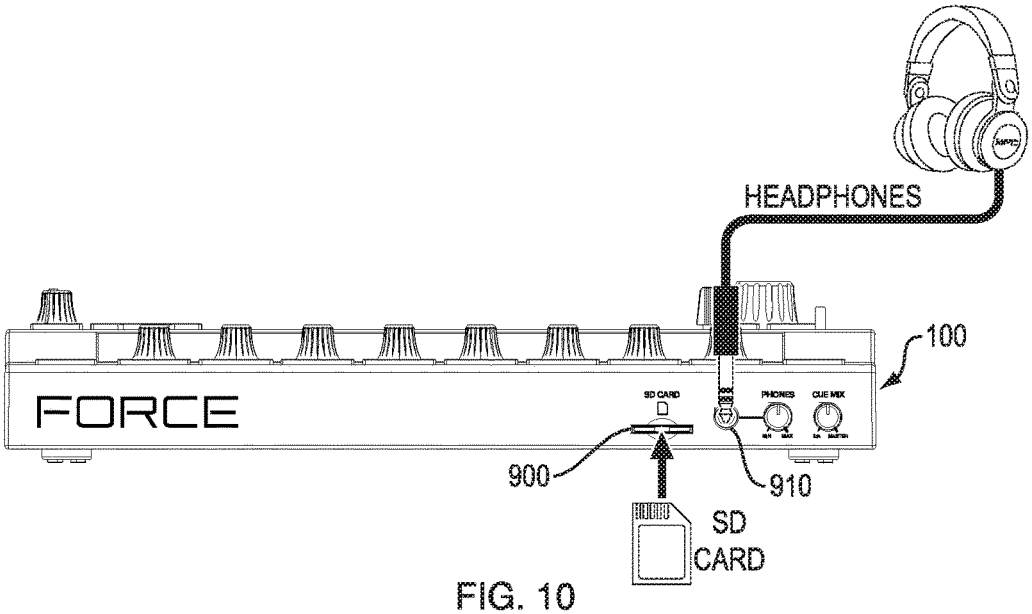
FIG. 10 illustrates conceptually is a front view of the device of FIG. 1 in accordance with the disclosure.

FIG. 10 is a front view of device 100 comprising a front panel of the device 100 including one or more input ports 900 for removable media such as an SD Card Slot, one or more outputs 910 for a stereo headphone, and one or more controls 920 including a headphone Gain knob, Line/Inst switches, or other controls. In some embodiments, such controls may be disposed on rear panel of the device.

Figure 11:
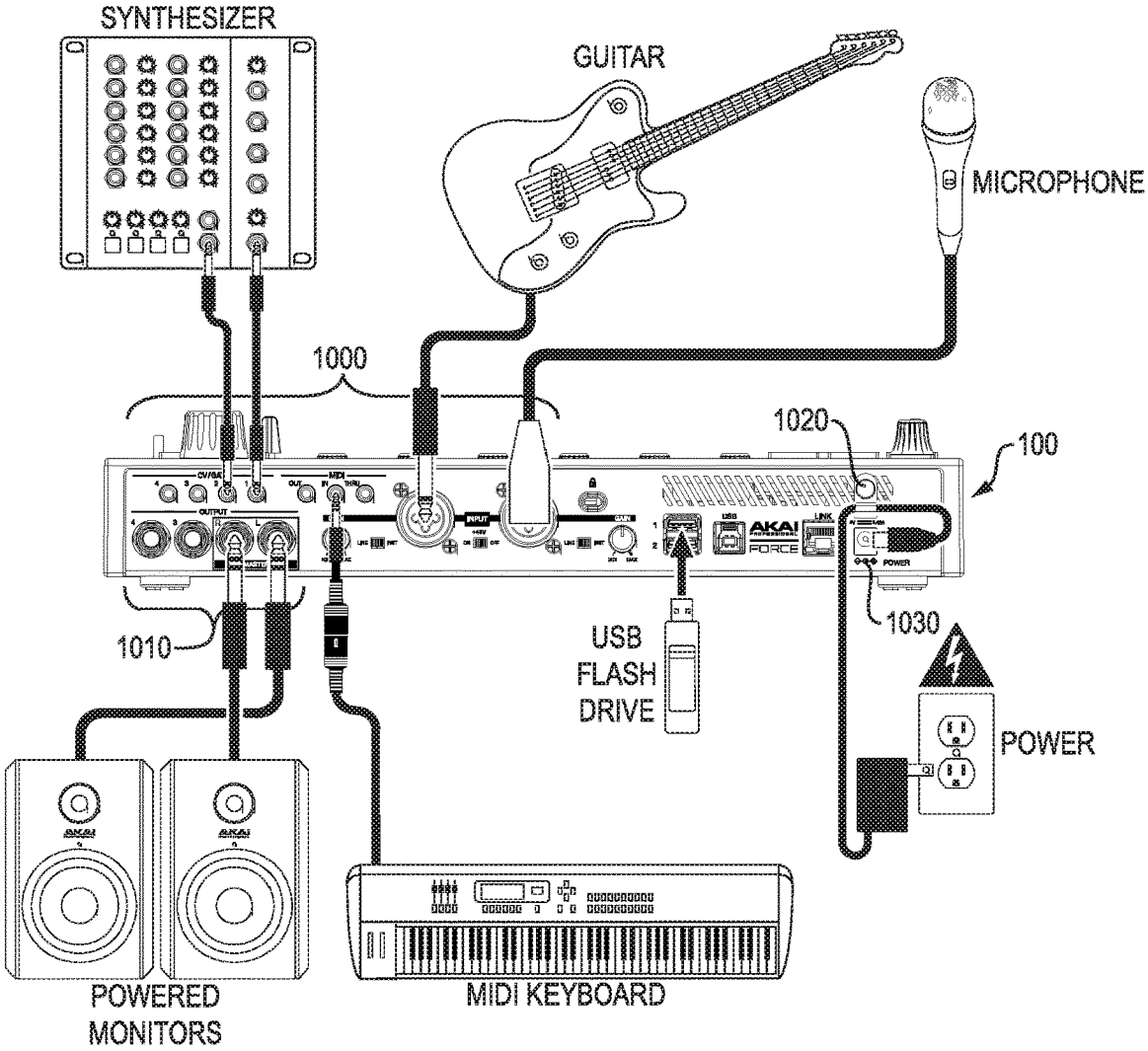
FIG. 11 illustrates conceptually is a rear view of the device of FIG. 1 in accordance with the disclosure.

FIG. 11 is a rear view of device 100 comprising a rear panel including one or more input ports 1000, one or more outputs 1010, a power switch 1020, and a power input 1030. Input ports 1000 may include computer ports for Ethernet cable, USB, and standard audio ports including XLR, ¼" jacks, TRS cables, as well as MIDI In, MIDI Out, and MIDI Thru ports. Output ports 1010 may include computer ports for Ethernet cable, USB, and standard audio ports including ¼" jacks, TRS cables, as well as MIDI Out, MIDI Thru, and CV/Gate Out.

Figure 3:
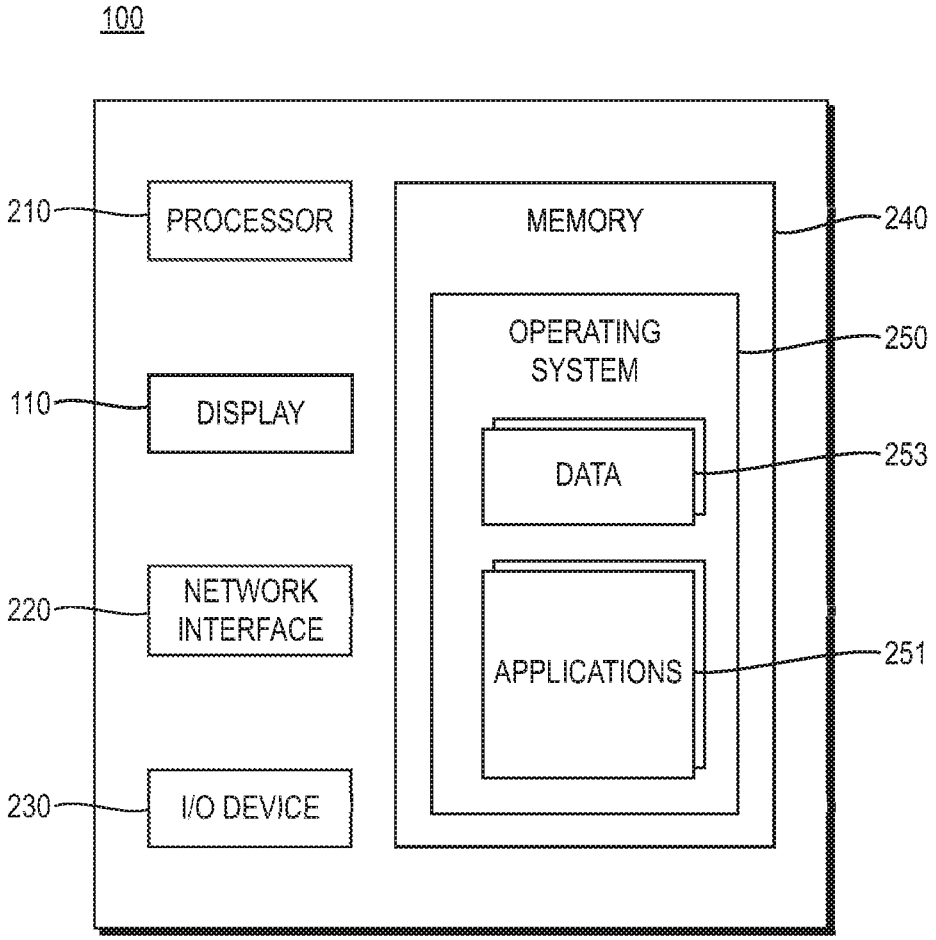
FIG. 3 illustrates conceptually a functional block diagram of the device of FIG. 1 in accordance with the disclosure.

FIG. 3 is a conceptual illustration of the logical components of device 100 which comprises one or more processors 210, a display 110, a network interface 220, an I/O device/interface 230, and one or more memory device 240 storing, an operating systems 250, and one or more executable applications 251, each comprising one or more computer instructions executable by processor 210 under the control of operating system 250. In addition, memory device 240 may store data 253 of various types and formats, such as audio samples which comprise clips and MIDI data.

Processor 210 may include one or more known processing devices, such as a microprocessor from the Pentium™ or Xeon™ family manufactured by Intel™, the Turion™ family manufactured by AMD™, the "Ax" or "Sx" family manufactured by Apple™. The disclosed embodiments are not limited to any type of processor(s) configured in computing device 200. In one implementation the processor 210 may be implement with a special purpose Digital Signal Processing (DSP) chip including any associated RAM, ROM, working registers and other associated memory, and which may or may not include analog-to-digital converters and digital-to-analog converters within the same semiconductor package. It should be understood, however, that processor 210, in some embodiments, may be particularly adapted and configured to perform steps related to the computer implemented device for music production. For example, processor 210 may include an ability to handle two different instructions simultaneously and execute the instructions on the display and pads.

Network interface 220 may be any type of network configured to provide communications between computer implemented device 100 and an external computer. For example, network 220 may be any type of network (including infrastructure) that provides communications, exchanges information, and/or facilitates the exchange of information, such as the Internet, a Local Area Network, Near Field Communication (NFC), WIFI, Bluetooth®, or other suitable connection(s) that enables the sending and receiving of information between the computer implemented device 100 and an external computer.

I/O devices 230 may be one or more devices configured to allow data to be received and/or transmitted by computer implemented device 100. I/O devices 230 may include one or more digital and/or analog communication devices that allow components of computer implemented device 100 to communicate with each other or any other device.

Operating system 250 may perform known operating system functions when executed by processor 210, acting as the interface between the machine model of processor 210 and the various user interfaces of device 100 to control execution of applications 251 and processing of data 253 in the matter as described herein. By way of example, the operating system may be implemented with many of the Force Firmware, Android™, Apple OS X™, Unix™, Linux™, or available operating systems.

Memory 240 may include one or more memory devices that store data and instructions used to perform one or more features of the disclosed embodiments. For example, memory 240 may represent a tangible and non-transitory computer-readable medium having stored therein computer programs, sets of instructions, code, or data to be executed by processor 210.

Memory 240 may include, for example, a removable memory chip (e.g., EPROM, RAM, ROM, DRAM, EE PROM, flash memory devices, or other volatile or non-volatile memory devices) or other removable storage units that allow instructions and data to be accessed by processor 210. Memory 240 may collectively comprise a number of different memory device implementations including any of magnetic, semiconductor, tape, optical, removable, non-removable, or other type of storage device or tangible (i.e., non-transitory) computer-readable medium.

Memory 240 may collectively comprise a number of different memory device implementations including any of magnetic, semiconductor, tape, optical, removable, non-removable, or other type of storage device or tangible (i.e., non-transitory) computer-readable medium.

Applications 251 stored in memory 240 may include instructions that, when executed by processor 210, perform operations consistent with the functionalities disclosed herein. Devices consistent with disclosed embodiments are not limited to separate programs or computers configured to perform dedicated tasks. For example, memory 240 may include one or more applications 251 to perform one or more functions of the disclosed embodiments. By way of further example, program 251 may include Force Software or others.

Multi-Mode Operation

Figure 4:
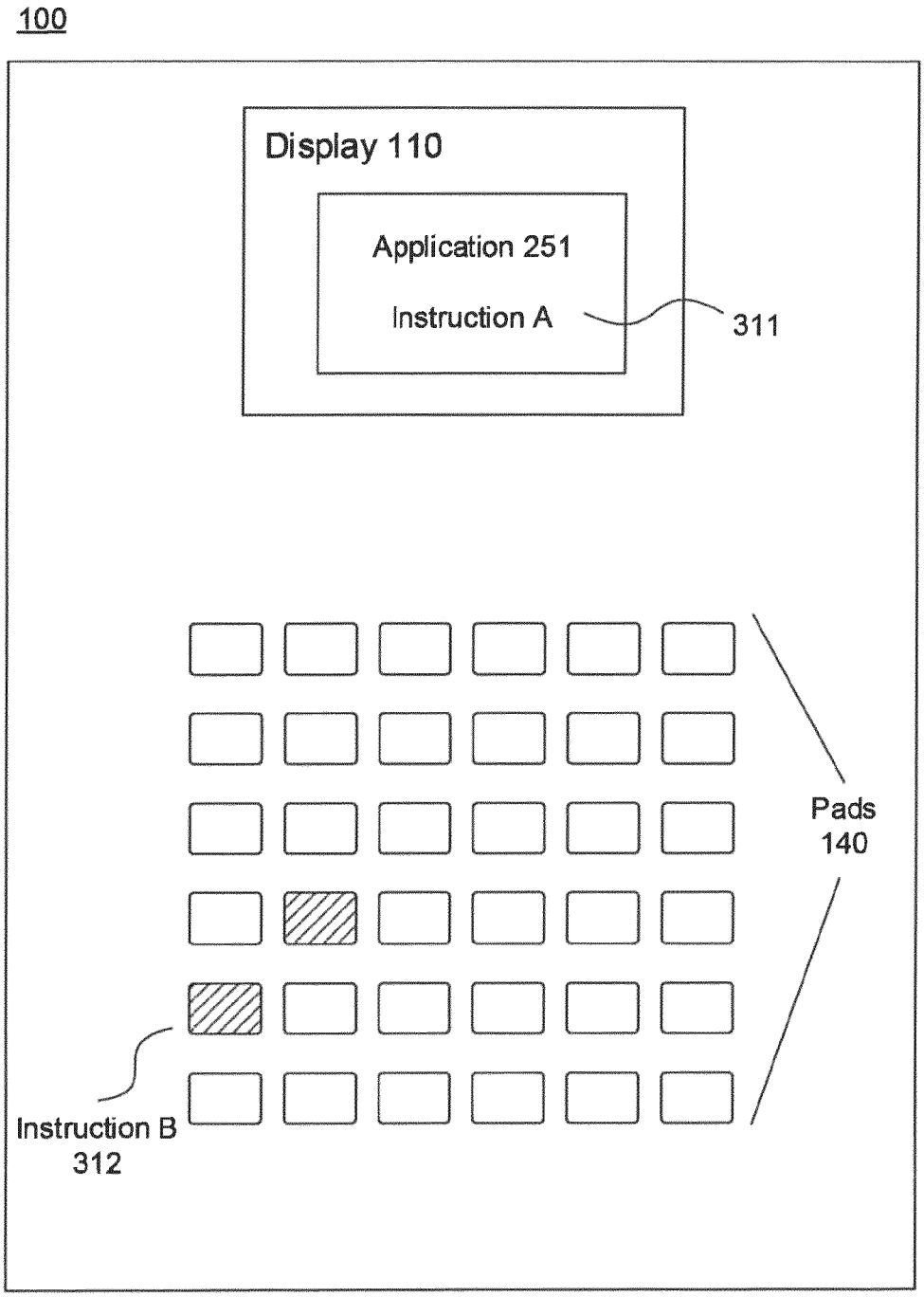
FIG. 4 illustrates conceptually execution of different instructions from a display and a pad of the device of FIG. 1 in accordance with the disclosure.

FIG. 4 illustrates conceptually a computer implemented device 100 with the display 110 executing an application 251 which places the display in a first operational mode and enables users to select through the touch sensitive display command instructions 311. For example, display 110 may be in the "launch" mode of operation in which a plurality of graphic elements each representing a clip are presented on a virtual image on display 110, touching any one of which will initiate loading of the corresponding clip from memory 240. Simultaneously, actuator pad array 140 may be in a note mode of operation in which the actuator pads may be correlated with scale notes, selection of which by the user causes instruction B 312 to execute thereby transmitting note and MIDI data information similar to a MIDI keyboard to the application currently executing association with pad 140. In this matter, a user may launch a clip on the display 110 while playing a note on pad array 140. Thus, a user has simultaneous control of the display and pad array which operate independently of each other in different operational modes.

According to one aspect of the disclosure, the actuator pad matrix may be user definable to operate in multiple separate sections each of which has its own independent mode of operation. For example, a user may divide the pad matrix and use half of pads to play clips and the other half of pads to play drum note. This allows a user to have more flexibility with usage of the pads. FIG. 5 illustrates conceptually actuator pad array 140 which is dividable through selection of one of controls 120 into separate sections. In an illustrated embodiment, actuator pad 140 is an 8×8 matrix which may be separated into multiple separate subgroups of four rows each, as illustrated. Each of the subgroups may operate separately from the other in its own respective operational mode. For example, limit of Split in half to execute instruction C 400 and Instruction D 410. For example, pads 140 may be split into one or more areas to operate one or more instructions simultaneously. By way of further example, a user can press a highlighted pad 420 causing execution of an Instruction C to play the clip assigned to the pressed pad 420 when in the first subgroup of pads 400 is in the record mode. Simultaneously, a user can press the circled pad 430 causing execution of an Instruction D to trigger a drum sound assigned to the pad 430, when the second subgroup of pads 410 is in the drum mode.

Figure 6:
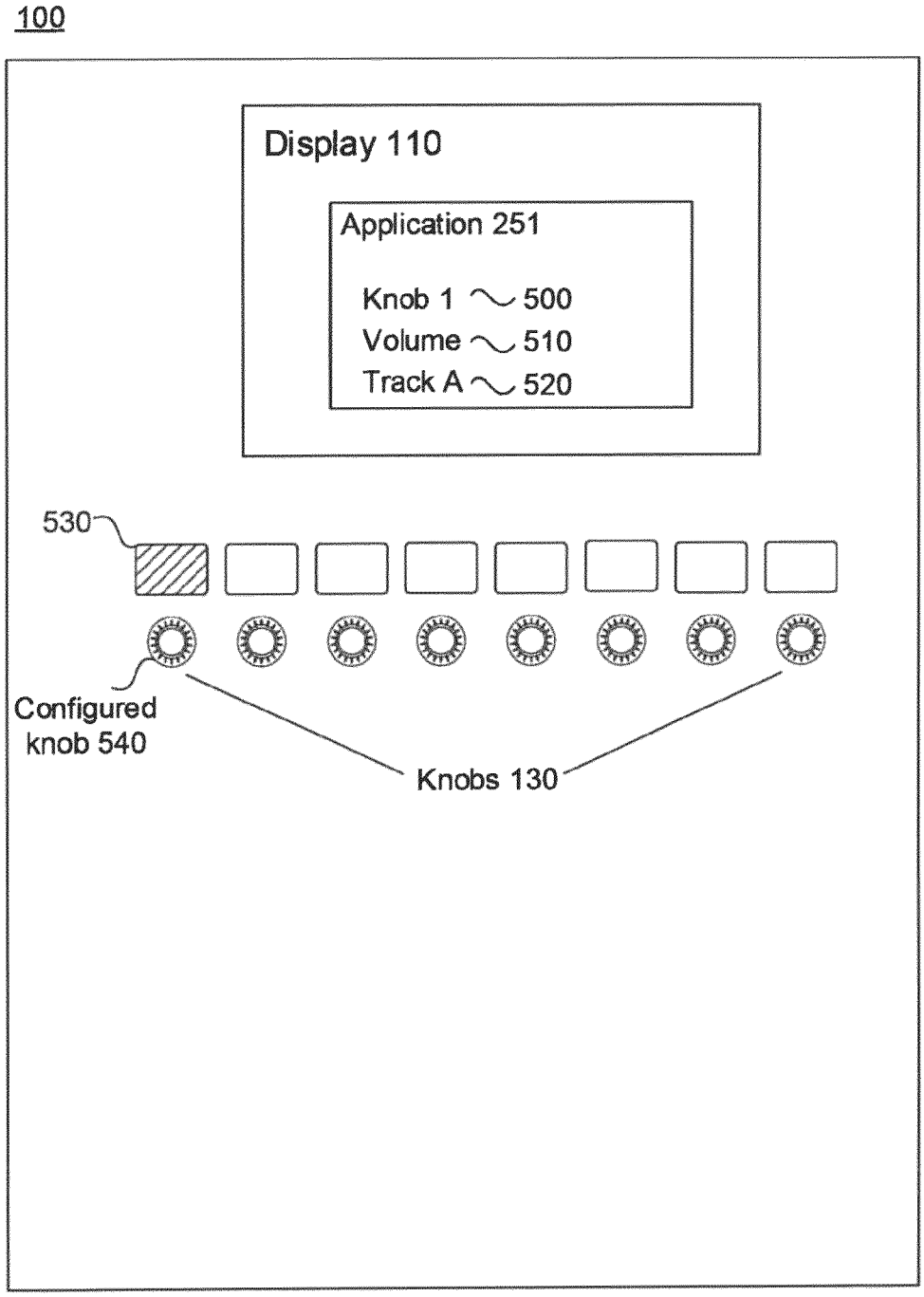
FIG. 6 illustrates conceptually a diagram of various controls configured to execute different instructions from a display and/or pad in accordance with the disclosure.

In some embodiments, the processor may further execute configuring a knob to perform independent instruction. For example, a user may configure knob by the display to control track volume. This allows a user to have independent and flexible control. FIG. 6 illustrates conceptually exemplary knob 540 of programmable knobs 130 configured to execute control of a volume parameter 510 of a track A 520, when the display 110 is in the mixing mode. The display 110 further shows knob 1 500 is configured from the application 251 controlling the mixing operational mode. A highlighted dedicated secondary display 530 associated with configured knob 540 indicates that the knob 540 is selected to perform an instruction assigned to it. For example, a user may configure knob 540 by the display 110 to control track 520 volume. This allows the user to have independent and flexible control. The display 530 will also indicate the level of the parameter, such as volume in this case.

Figure 7:
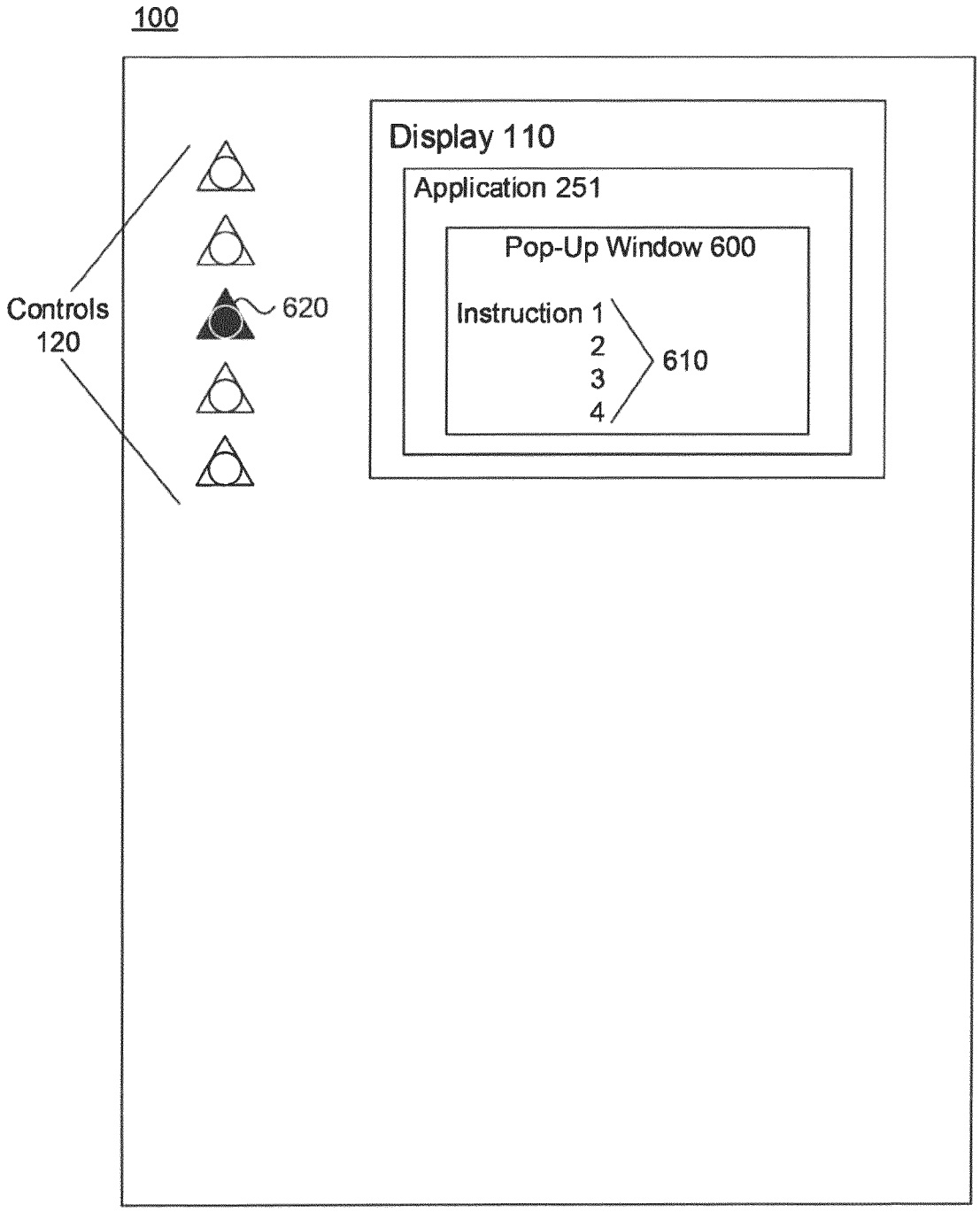
FIG. 7 illustrates conceptually a pop-up window on a display of the device to enable a user to dynamically select different instructions in accordance with the disclosure.

According to another aspect of the disclosure, interaction between physical controls and the touch display is possible. For example, pressing and holding down a controller 120 will generate a pop-up window on the display 110 allowing the user to dynamically select different modes using the touch display 110; releasing the button will end the gesture and closing the pop-up window. FIG. 7 illustrates conceptually a pop-up window 600, generated by an application 251, on the display 110 by selection of the highlighted control 620. The pop-up window 600 further shows different instructions options 610, allowing a user to dynamically select different instructions. Control 620 may be a physical control. For example, pressing a physical control 620 may allow a user to generate exemplary pop-up window 600 to select different instructions 610 and releasing the control 620 to close the window 600.

Figure 8A:
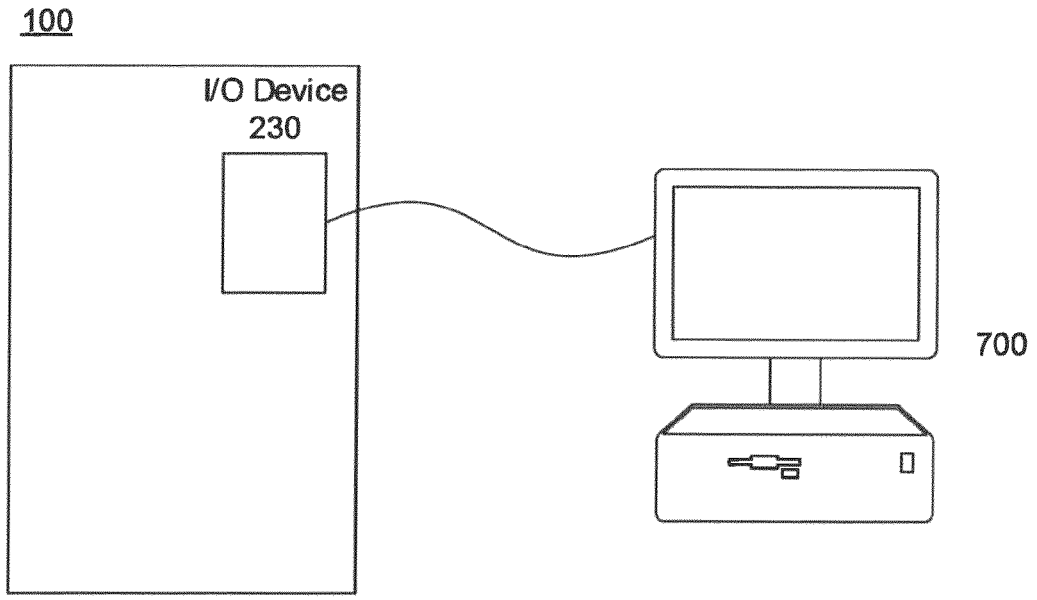
FIGS. 8A and 8B illustrates conceptually schematic representations of the exemplary device of FIG. 1 connected to a computer via a wired and wireless connection, respectively, accordance with the disclosure.
Figure 8B:
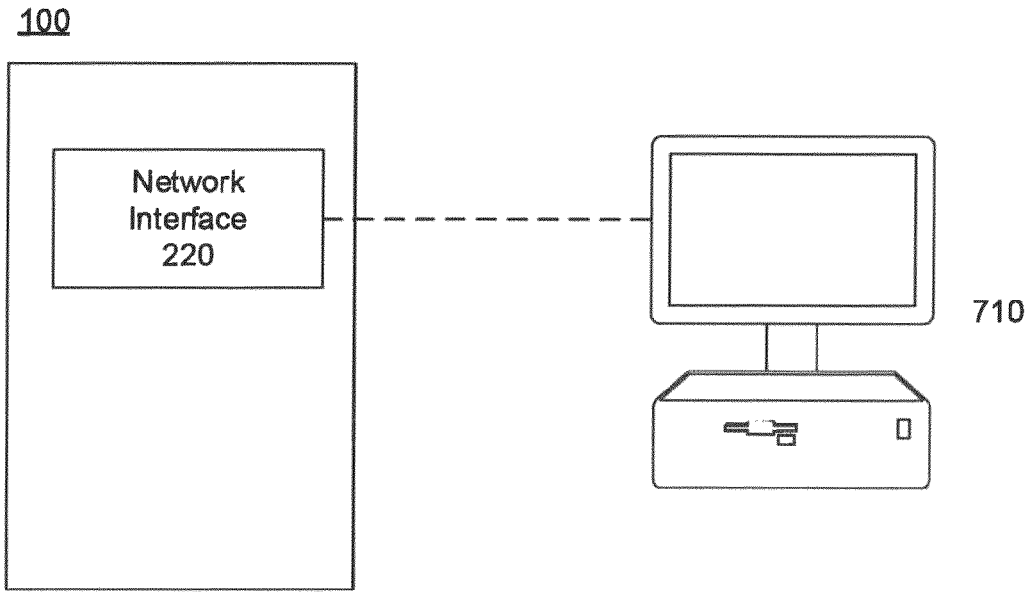

In some embodiment, a computer implemented device for music production works as a full stand-alone product without support of a computer. In other embodiments, the device may work as control surface controlling an application running on a computer via wired connection or a wireless connection. For example, a user may decide to configure a device to work as a full stand-alone product or to work with a connected computer. FIG. 8A is a conceptual representation of I/O device 230 of device 100 connected to a computer 700 by a network technology. FIG. 8B is a schematic representation of wireless connection between a computer 710 and a device 100 by network interface 220 of the device 100. For example, a user may decide to use the device 100 as a control surface controlling an application running on a computer 700 or 710 via either a wired connection of FIG. 8A or wireless connection of FIG. 8B.

Figure 9:
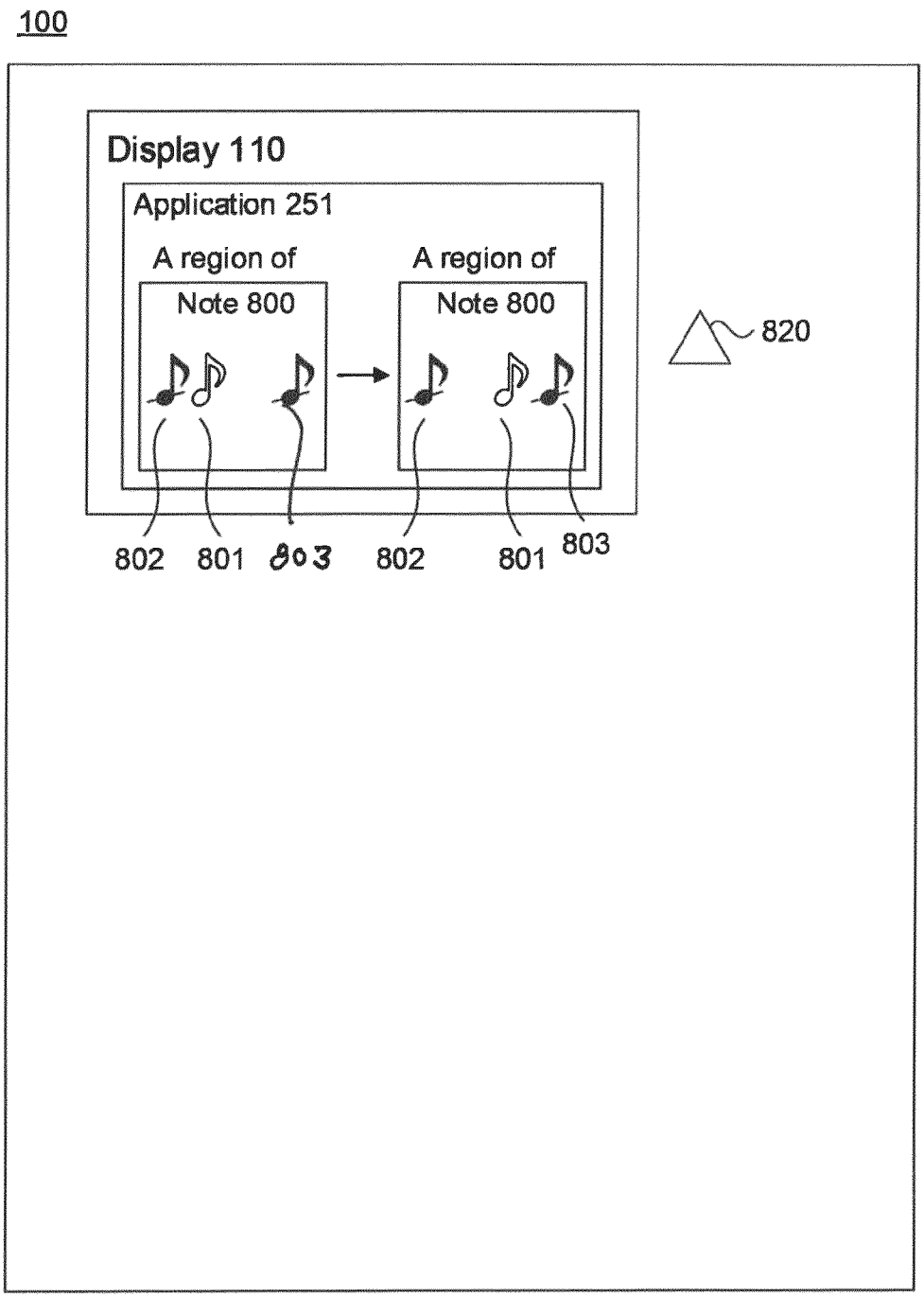
FIG. 9 illustrates conceptually a selected note in region of notes shown on a display of the device, which timing position in the composition is altered using the device in accordance with the disclosure.

In some embodiments, the processor may further execute selecting and moving a note from a region of notes using a display and control. For example, a user may select a note from a region of notes with a display and then moving the note precisely by turning the encoder the desired number of clicks. FIG. 9 illustrates conceptually adjustment of a note 801 inside a region of notes 800, e.g. a clip, shown on the display 110 by an application 251. A user may configure control 820 to move the note 801 precisely, from location close to note 802 to the location closer to note 803, where the closeness of the notes represents a difference in the relative timing of the note 801 relative to notes 802 and 803.

Figure 12:
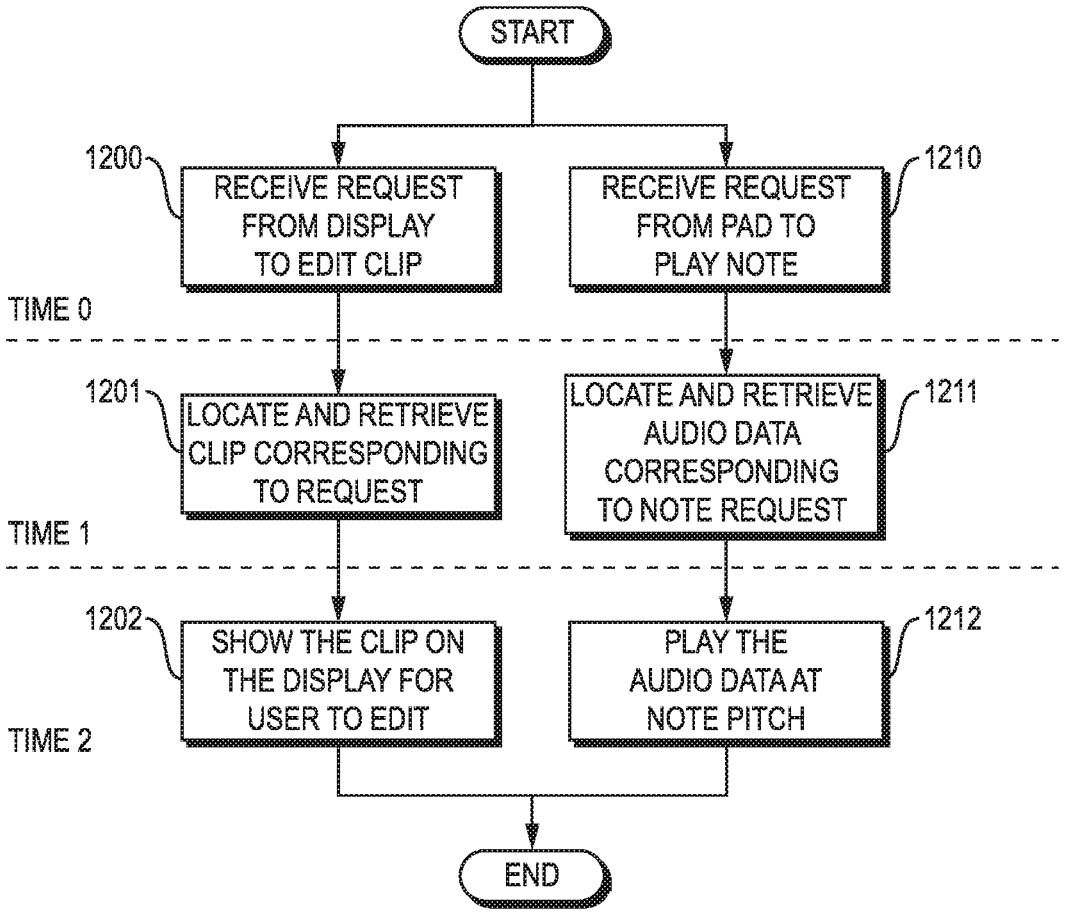
FIG. 12 is a flowchart illustrating the steps for simultaneously operating the various control surfaces of the device of FIG. 1 while in different modes in accordance with the disclosure.

FIG. 12 is a flow chart illustrating substantially simultaneous execution of two instructions, one entered through display 110 and the other entered through pad array 140. At time 0, processor 210 receives a request entered through multi-touch display 110 to edit clip a clip associated with the region of the display selected, as illustrated by block 1200. Substantially simultaneously therewith processor 210 receives a request entered through pad array 140 to play note, as illustrated by block 1210. At time 1, the processor 210 locates in memory 240 the audio data 235 comprising designated clip corresponding to the request from display, as illustrated by block 1201. Substantially simultaneously therewith processor 210, retrieves the audio data corresponding to the note request entered through pad array 140, as illustrated by block 1211. At time 2, the processor 210 displays the virtual image of the clip in editable format on the display 110 for user to edit, as illustrated by block 1202. Substantially simultaneously therewith, and audio engine algorithm generates the sound representing the selected note in accordance with the pitch and other dynamics/MIDI parameters entered through the pad of array 140, as illustrated by block 1212. Thereafter, the processor 210 may receive other instructions from the display 110 and pad array 140, combination with configuring controls 120 or from patrols went on to themselves. For example, a processor may receive a request from display to create a project while receiving a request from pad to edit a sample in combination with a configuration of physical control. By way of further example, a user may edit the sample from the pad by holding the physical control assigned for editing and pressing the relevant pad.

In accordance with the disclosed device 110, one or more processes simultaneously executing under the control of the operating system 250, may receive a request for editing a clip through the display 110 while simultaneously receiving input data from the pad array 140, with each of the display and pad array operating in their own different perspective operational modes.

In some embodiments, the processor may further synchronize playing clips. In other embodiments, the device may play clips in a loop. For example, a device ensures that a clip that is played with other clips is in synchronous timing with other playing clips by adjusting a tempo of all playing clips to identical tempo. By way of further example, the synchronized clips may be looped. As used herein, a clip is a data structure containing either recorded audio or MIDI information. Clips that share a common type, such as clips of a particular drum kit or plug-in may be grouped into tracks. Clips across multiple tracks in the same row of array 140 may be grouped into scenes. MIDI clips contain MIDI note event and controller data. Audio clips contain an audio signal that has been recorded or imported into the device 100 and can be edited.

The foregoing description has been presented for purposes of illustration. It is not exhaustive and is not limited to the precise forms or embodiments disclosed. Modifications and adaptations will be apparent to those skilled in the art from consideration of the specification and practice of the disclosed embodiments.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents falling within the scope of the disclosure may be resorted to.

Certain embodiments of the present disclosure can be implemented as software on a general-purpose computer or on another device. Computer programs, program modules, and code based on the written description of this specification, such as those used by the microcontrollers, are readily within the purview of a software developer. The computer programs, program modules, or code can be created using a variety of programming techniques. For example, they can be designed in or by means of Java, C, C++, assembly language, or any such programming languages. One or more of such programs, modules, or code can be integrated into a device system or existing communications software. The programs, modules, or code can also be implemented or replicated as firmware or circuit logic.

Another aspect of the disclosure is directed to a non-transitory computer-readable medium storing instructions which, when executed, cause one or more processors to perform the methods of the disclosure. The computer-readable medium may include volatile or non-volatile, magnetic, semiconductor, tape, optical, removable, non-removable, or other types of computer-readable medium or computer-readable storage devices. For example, the computer-readable medium may be the storage unit or the memory module having the computer instructions stored thereon, as disclosed. In some embodiments, the computer-readable medium may be a disc or a flash drive having the computer instructions stored thereon.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Moreover, while illustrative embodiments have been described herein, the scope of any and all embodiments include equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present application. The examples are to be construed as non-exclusive. Furthermore, the steps of the disclosed methods may be modified in any manner, including by reordering steps and/or inserting or deleting steps. It is intended, therefore, that the specification and examples be considered as illustrative only, with a true scope and spirit being indicated by the following claims and their full scope of equivalents.

What is claimed is:

1. A music production device comprising:

an array of actuator pads;

a touch sensitive display;

a processor operatively coupled to the array of actuator pads and the display and responsive to user commands for assigning a mode of operational to each of the display and at a subgroup of the actuator pads, wherein the processor is capable of configuring the display into a launch mode of operation enabling touch initiated launching of sound samples and further capable of configuring the subgroup of the actuator pads simultaneously into a note mode of operation for enabling touch initiated notes or MIDI events.

2. The music production device of claim 1 further comprising:

a plurality of controllers operatively coupled to the processor, and wherein the processor is responsive to a user commands for assigning a mode of operational to the plurality of controllers, and wherein the array of actuator pads, the display and the plurality of controllers are configurable to simultaneously operate in different respective modes of operation.

3. The music production device of claim 1 wherein the controllers comprise one or more potentiometers.

4. The music production device of claim 3 wherein at least one of the controllers has associated therewith a dedicated display window.

5. The music production device of claim 1 wherein the array of actuator pads is dividable into a first subgroup of actuator pads and a second subgroup of actuator pads, and wherein the processor is responsive to user commands for assigning a mode of operation to the first subgroup of actuator pads and is further responsive to user commands for assigning a different mode of operation to the second subgroup of actuator pads, and wherein the first subgroup of actuator pads and the second subgroup of actuator pads are operable simultaneously in different respective modes of operation.

6. The music production device of claim 5 wherein at least one of the first subgroup of actuator pads and the second subgroup of actuator pads is velocity sensitive.

7. A music production device comprising:

an array of actuator pads:

a touch sensitive display;

a processor operatively coupled to the array of actuator pads and the displa and responsive to user commands for assigning a mode of operational to each of the display and at least a subgroup of the actuator pads, wherein the processor is capable of configuring the display into an edit mode of operation enabling editing of sound samples and further capable of configuring the subgroup of the actuator pads simultaneously into a note mode of operation for enabling touch-initiated notes or MIDI events.

8. A method for producing music comprising:

A) providing a music production device comprising:

i) an array of actuator pads;

ii) a touch sensitive display; and iii) a processor operatively coupled to the array of actuator pads and the display and responsive to user commands for assigning a mode of operational to each of the display and at least a subgroup of the actuator pads, wherein the display and the subgroup of the actuator pads are simultaneously operable in different respective modes of operation;

B) receiving a user command initiating entry of the display into a first mode of operation;

C) receiving a user command initiating entry of the array of pad actuators into a second mode of operation, different from the first mode of operation of the display; and D) operating the display in a mode enabling the user to launch audio clips using the touch display while simultaneously operating the pad array is in a note mode, enabling a user to enter notes from the array of actuator pads.

9. The method of claim 8 wherein D) comprises:

D1) receiving user-defined data through the display when the display is operating in a first operational mode, D2) receiving user-defined data through the array of actuator pads while the array of actuator pads is simultaneously operating in a second operational mode, different from the first operational mode in which the display is operating.

10. The method of claim 9 wherein the array of actuator pads is dividable into a first subgroup of actuator pads and a second subgroup of actuator pads, and wherein the processor is responsive to user commands for assigning a first mode of operation to the first subgroup of actuator pads and is further responsive to user commands for assigning a different mode of operation to the second subgroup of actuator pads, and wherein the first subgroup of actuator pads and the second subgroup of actuator pads are operable simultaneously in different respective modes of operation.

11. The method of claim 10 wherein D) comprises:

D1) receiving user-defined data through the display when the display is operating in a first operational mode, D2) receiving user-defined data through at least one of the first subgroup of actuator pads and the second subgroup of actuator pads while the at least one of the first subgroup of actuator pads and second group of actuator pads is simultaneously operating in a second operational mode different from the first operational mode in which the display is operating.

12. A music production device comprising:

an array of actuator pads, the array of actuator pads dividable into a first subgroup of actuator pads and a second subgroup of actuator pads;

a touch sensitive display;

a plurality of controllers;

a processor operatively coupled to the array of actuator pads, the touch sensitive display and the plurality of controllers; and wherein the processor is responsive to user commands for assigning a mode of operational to the first subgroup of actuator pads, the second subgroup of actuator pads, the touch sensitive display and the plurality of controllers wherein the processor is capable of configuring the display into a launch mode of operation enabling touch initiated launching of sound samples and further capable of configuring one of the first and second subgroups of actuator pads simultaneously into a note mode of operation for enabling touch initiated notes or MIDI events.

13. The music production device of claim 12 wherein the one of the first and second array of actuator pads, the display and the plurality of controllers are configurable to simultaneously operate in different respective modes of operation.

14. The music production device of claim 12 wherein each of the one of the first and second array of actuator pads, the display and the plurality of controllers are configurable to simultaneously operate in different respective modes of operation.

15. A music production device comprising:

an array of actuator pads, the array of actuator pads dividable into a first subgroup of actuator pads and a second subgroup of actuator pads, a touch sensitive display:

a plurality of controllers;

a processor operatively coupled to the array of actuator pads, the touch sensitive display and the plurality of controllers; and wherein the processor is responsive to user commands for assigning a mode of operational to the first subgroup of actuator pads, the second subgroup of actuator pads, the touch sensitive display and the plurality of controllers wherein the processor is capable of configuring the display into a edit mode of operation enabling editing of sound samples and further capable of configuring one of the first and second subgroups of the actuator pads simultaneously into a note mode of operation for enabling touch initiated notes or MIDI events.

* * * * *